US007300347B1

(12) United States Patent
Forbes

(10) Patent No.: US 7,300,347 B1
(45) Date of Patent: Nov. 27, 2007

(54) WAGERING GAMING AND METHOD OF PLAY

(75) Inventor: Jack Forbes, Las Vegas, NV (US)

(73) Assignee: Creative Gaming Concepts, Inc., Las Vegas, NV (US)

( * ) Notice: Subject to any disclaimer, the term of this patent is extended or adjusted under 35 U.S.C. 154(b) by 575 days.

(21) Appl. No.: 10/649,846

(22) Filed: Aug. 26, 2003

(51) Int. Cl.
*A65F 1/00* (2006.01)

(52) U.S. Cl. ..... 463/13; 463/11; 463/20

(58) Field of Classification Search ..... 463/11, 463/12, 13, 20
See application file for complete search history.

(56) References Cited

U.S. PATENT DOCUMENTS

| | | | | |
|---|---|---|---|---|
| 3,876,208 | A | 4/1975 | Wächtler et al. | |
| 5,033,744 | A * | 7/1991 | Bridgeman et al. | 463/13 |
| 5,098,107 | A | 3/1992 | Boylan et al. | |
| 5,332,219 | A * | 7/1994 | Marnell, II et al. | 463/13 |
| 5,845,906 | A | 12/1998 | Wirth | |
| 5,947,821 | A | 9/1999 | Stone | |
| 6,062,980 | A * | 5/2000 | Luciano | 463/20 |
| 6,070,873 | A | 6/2000 | Perkins | |
| 6,113,101 | A | 9/2000 | Wirth | |
| 6,227,969 | B1 * | 5/2001 | Yoseloff | 463/13 |
| 6,234,485 | B1 | 5/2001 | Perkins | |
| 6,342,007 | B1 * | 1/2002 | Wood et al. | 463/13 |
| 2002/0190469 | A1 | 12/2002 | Conklin et al. | |

* cited by examiner

*Primary Examiner*—Xuan M. Thai
*Assistant Examiner*—Josh Wert
(74) *Attorney, Agent, or Firm*—Rob L. Phillips; Greenberg Traurig

(57) ABSTRACT

A wagering game facilitated by an electronic gaming machine. The game enhances conventional video poker by providing players a realistic opportunity to hit a royal flush. Ideally, players are provided an option to place a second wager once five initial cards are displayed. In response to the placement of the second wager, the machine replaces the a number of non-hold cards with royal flush cards such that the player holds four cards to the royal flush. Then a final card is displayed. If a royal flush is displayed, the player receives a payout of 40:1 or more on the second wager. With one of the embodiments described herein, the probability of a hitting a royal flush is decreased to 45:1. In an alternative embodiment, players are provided with a number of cards so that they hold two or three cards to the royal flush.

18 Claims, 4 Drawing Sheets

300

| | DEALT THREE CARDS INITIALLY TO THE ROYAL (i.e., PROVIDED ONE REPLACEMENT ROYAL FLUSH CARD) | DEALT TWO CARDS INITIALLY TO THE ROYAL (i.e., PROVIDED TWO REPLACEMENT ROYAL FLUSH CARDS) | DEALT ONE CARD INITIALLY TO THE ROYAL (i.e., PROVIDED THREE REPLACEMENT ROYAL FLUSH CARDS) |
|---|---|---|---|
| ODDS<br>PAYOUT<br>HOUSE EDGE | 44:1<br>44 FOR 1<br>2.22% | 45:1<br>45 FOR 1<br>2.17% | 46:1<br>46 FOR 1<br>2.13% |
| PAYOUT<br>HOUSE EDGE | 43 FOR 1<br>4.44% | 44 FOR 1<br>4.35% | 45 FOR 1<br>4.26% |
| PAYOUT<br>HOUSE EDGE | 42 FOR 1<br>6.67% | 43 FOR 1<br>6.52% | 44 FOR 1<br>6.38% |

FIG. 4

WAGERING GAMING AND METHOD OF PLAY

FIELD OF INVENTION

The embodiments of the present invention relate generally to casino wagering. More particularly, a poker based wagering game particularly particular suitable for implementation in a gaming device is disclosed herein.

BACKGROUND

Slot machines, video poker machines, keno machines and other electronic gaming devices have seized the majority of casino floor space. Besides being attractive to players, electronic gaming devices are attractive to casinos as they generate substantial revenue and facilitate easy accounting procedures. One overwhelmingly popular wagering game which is implemented in an electronic gaming device is video poker.

The success of video poker is based on many attributes, including ease and speed of play and its large payback parameters (e.g., 93% to 100%). Video poker is generally played as follows: A player first places a wager and then causes the video poker machine to reveal five randomly simulated playing cards from a standard 52-card deck of playing cards. The player is then able to discard any number (i.e., 0-5) of the five cards initially displayed. Then, once the player has selected which cards to hold and discard, the video poker machine randomly replaces the discards with cards remaining in the deck. Based on the poker ranking of the final five cards, the player either loses the wager or is awarded a payout. The amount of the payout increases as a function of the poker ranking as depicted in a pay table of the respective machine. Thus, a straight may pay 20 coins and a full house may pay 45 coins. The highest hand achievable is the "Royal Flush", which typically pays out 4000 coins on a maximum bet placed on a five coin maximum bet machine.

Many video poker machines allow players to play from 1 to 5 coins. Video poker machines pay out winning hands on a relatively linear relationship to the number of coins played. In other words, with one coin played, a straight may pay out 4 coins, with two coins played the straight may pay out 8 coins, with three coins played the straight may pay out 12 coins, with four coins played the straight may pay out 16 coins and finally with five coins played the straight may pay out 20 coins. However, the payout for a royal flush is increased in a non-linear fashion when five coins are played. Thus, although the linear payout should be 1250 coins for 5 coins played, the payout is typically 4000 coins. Increased payouts encourage players to pursue the royal flush over other possible winning combinations, which favors a casino's bottom line. However, the mathematical probability of a player being dealt a royal flush or drawing a royal flush is approximately 43,000 to one. Therefore, assuming an average player who plays five hands per minute or 300 hands per hour, it would theoretically take 143 hours to hit the royal flush. Playing four hours a day, every day, will compel a player to play over 35 days to hit the royal flush. Of course theoretical and actual play time may vary. Most players, and certainly tourist, do not have the time nor the desire to dedicate such time to hitting the royal flush.

Certain new variations to video poker have reduced the amount of time it takes to hit a royal flush. For example, a game known as TRIPLE PLAY POKER® allows players to play hold cards from a first hand in three separate simultaneously played hands. Thus, three hands can be played in the time it takes to play one hand on a conventional video poker machine. In addition, TRIPLE PLAY POKER® has been augmented to ten, fifty and even one hundred simultaneously played hands. Such an increase in the number of played hands, has naturally reduced the time needed to hit a royal flush. Unfortunately, even with the aforementioned variations, casual players still rarely hit the royal flush. Moreover, in theory, it still costs the same amount of money to hit the royal flush under any of the previous examples.

Regardless of the probability of hitting the royal flush, certain players are known to hit more than their mathematical share of royal flushes. In fact, players talk about the number of royal flushes they have hit with great pride. Normally, the particular video poker game which provided the royal flush is not important to the prideful victor. Therefore, any means for improving the probability of hitting royal flushes is important to such competitors.

Thus, there is a need for a poker based wagering game which provides players with a more realistic opportunity to hit royal flushes with some degree of frequency.

SUMMARY

Accordingly, the embodiments of the present invention are first facilitated by an electronic gaming machine. For example, in a video poker machine which accepts 1 to 5 coins as a wager, a player makes his wager and once the coins are wagered, the gaming machine causes five randomly selected cards to be displayed on a gaming machine video display. Unlike conventional video poker, the player is then provided with an opportunity to dramatically increase (i.e., on a scale of one thousand) the probability of hitting a royal flush.

The opportunity arises in response to a player holding one or more (e.g., up to three) initial cards to the royal flush sequence. That is, the ten, jack, queen, king or ace of the same suit. If any one of the cards common to the royal flush should be displayed and the player holds the card or cards common to the royal flush, the player can opt to replace the remaining non-hold cards with royal flush cards such that the player will, upon completion, and prior to receiving a final draw card, be holding four to the royal flush sequence. The option requires the player to place a second wager. This option becomes available when one, two or three cards to the royal flush are held initially by the player. Alternatively, the player may only be permitted to replace a number of non-hold cards such that the player holds three or even two cards to a royal flush. Pursuant to such an alternative embodiment, the odds afforded the player are increased.

By providing a number of the missing royal flush sequence cards the royal flush is now possible with an extremely attractive frequency. In fact, the probability of drawing a royal flush after the second wager and with the player now holding four cards to the royal flush ranges from 44 to 1 to 46 to 1 rather than 43,000+ to one. This means the payouts can be greater than 40 to 1 on the wager.

Accordingly, the embodiments of the present invention provide an opportunity for players to hit the royal flush with more frequency. The benefits of the heretofore generally described game is explored in more detail below.

BRIEF DESCRIPTION OF THE DRAWINGS

FIG. 4 shows a table of probabilities, corresponding possible payouts and house edges.

DETAILED DESCRIPTION

The operation of electronic gaming machines, including slot machines and video poker machines, is well known in the industry so that the minute details are not set forth herein. In general terms, slot machines and video poker machines are controlled by processors including, or in communication with, a random number generator. The random number generator generates the machines' outcomes. A display in communication with the processor provides visual information to players.

Figure 1:
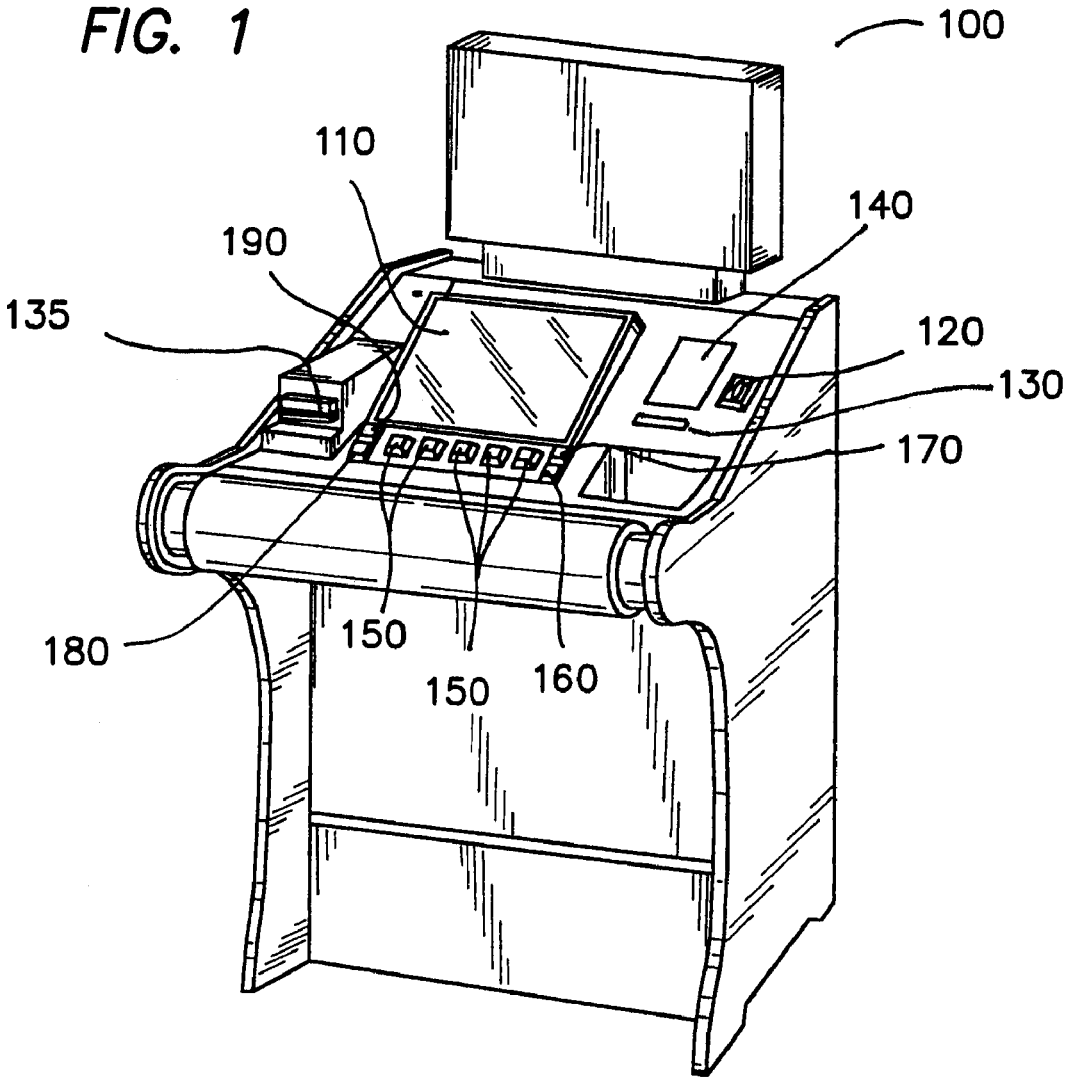
FIG. 1 shows a gaming machine for facilitating the embodiments of the present invention.

Reference is now made to the figures wherein like parts are referred to by like numerals throughout. FIG. 1 illustrates a perspective view of an electronic gaming machine for facilitating the embodiments of the present invention and is generally denoted by reference numeral 100. The general external features of the gaming machine 100, include a display 110, coin slot 120, a bill reader 130, a card reader 135 and a credit display 140. The gaming machine 100 also includes several player buttons which act as interfaces between the player and the machine processor. Player buttons include hold/discard buttons 150, a one coin wager button 160, a maximum coin wager button 170, a deal button 180 and a second wager button 190. While not shown, the machine 100 may also incorporate a ticket dispenser for printing tickets for redemption at a cashier window. Such cashless systems are becoming increasingly popular in most gaming jurisdictions. It is noted that any of the functions facilitated by the gaming machine buttons 150-190 can be accomplished by a display employing touchscreen technology.

Figure 2A:
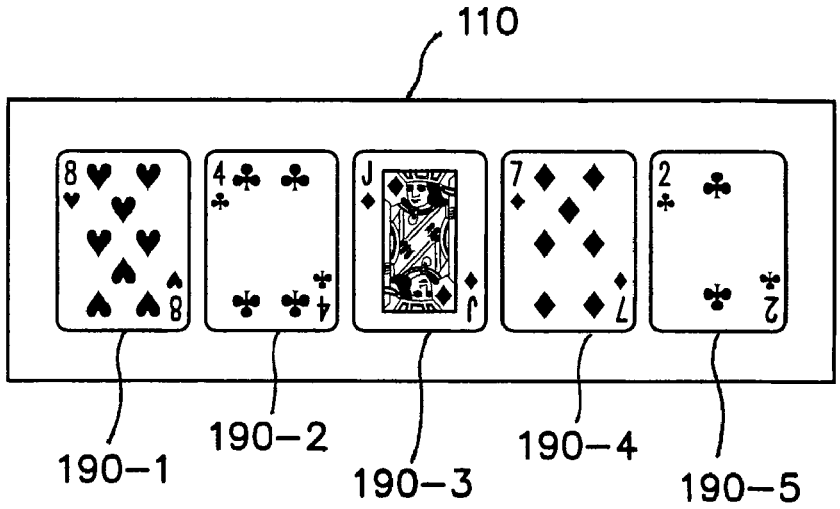
FIG. 2A shows an initial hand having one card to a royal flush.

Now referring to FIG. 2A, the display 110 is shown displaying five initial cards 190-1 through 190-5. The cards 190-1 through 190-5 are displayed once the player has placed an initial wager less than the maximum coin wager or used the one coin wager button 160 and pressed the deal button 180. Alternatively, the player may use the maximum coin wager button 170 which automatically causes the machine 100 to deal the initial five cards. Ideally, to participate in the embodiments of the present invention the player must play the maximum number of coins offered. However, it is not mandatory that the maximum number of coins be played as long as the game's payouts are adjusted accordingly. As illustrated, one card 190-3 is a royal flush card, namely the jack of diamonds. Should the player elect to hold the royal flush card 190-3 by means of the hold/discard buttons 150 or a touchscreen display, the player is provided the option of increasing the odds of receiving a royal flush in return for a second wager.

Anytime a player receives and holds one to three cards to a common royal flush, the gaming machine 100 may cause the display 110 to display a player inquiry such as "PLACE SECOND WAGER?" or something similar to alert the player that, based on his or her selected hold cards, the player has the option to place a second wager in return for receiving one to three cards to the royal flush. If the player does desire to place the second wager, he or she can use the second wager button 190 to instruct the gaming machine 100 to deduct a specific second wager amount from a credit amount depicted on credit display 140. Alternatively and additionally, the player may also insert additional money into the gaming machine 100 using known methods as described above. Once the inserted money has been recorded, the second wager button 190 may be used to deduct the specific wager amount desired.

Figure 2B:
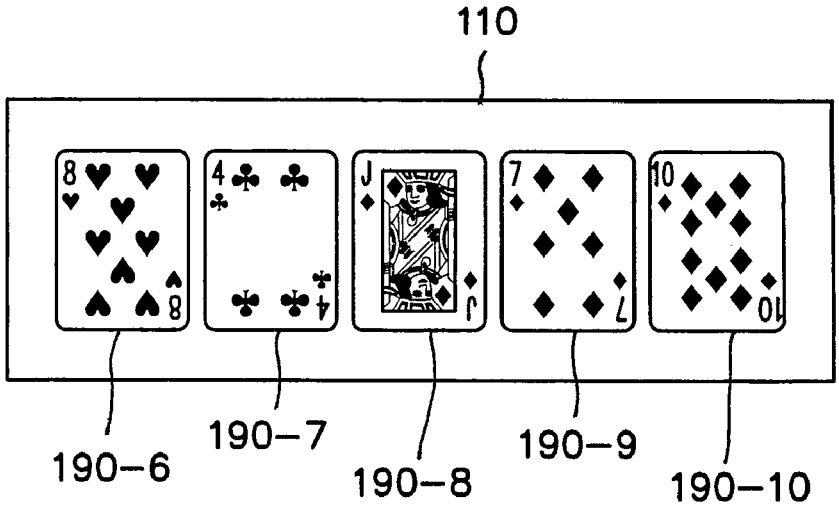
FIG. 2B shows an initial hand having two cards to a royal flush.
Figure 2C:
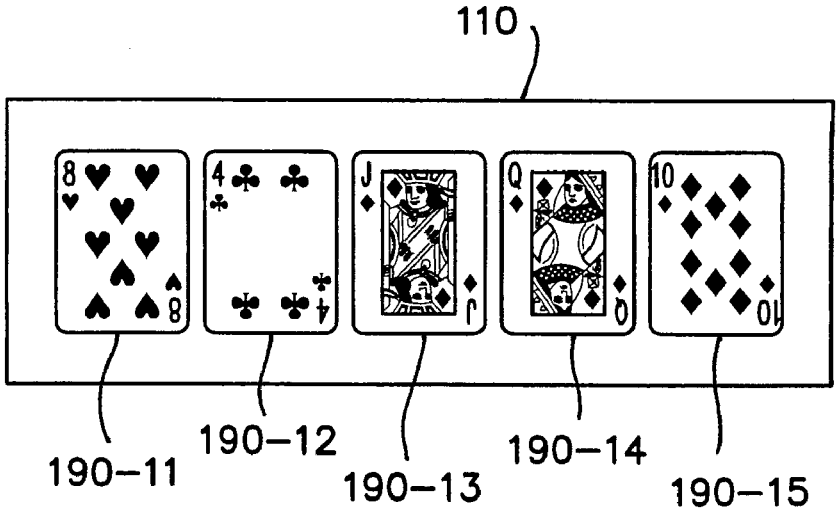
FIG. 2C shows an initial hand having three cards to a royal flush.

FIGS. 2B and 2C show other initial five card hands which have two and three cards, respectively, to a royal flush. In FIG. 2B, five cards 190-6 through 190-10 include two royal flush cards 190-8 and 190-10. In FIG. 2C, five cards 190-11 through 190-15 include three royal flush cards 190-13, 190-14 and 190-15. In either exemplary display, should the player elect to hold the royal flush cards, the gaming machine 100 automatically causes the display of the player inquiry noted above. Should the player then opt to place the second wager, a number of the non-hold cards are replaced such that the player is one card from a royal flush or four cards to a royal flush. As set forth below, and shown in FIG. 4, the odds and payouts are slightly altered depending on the number of royal flush cards displayed initially.

Figure 3:
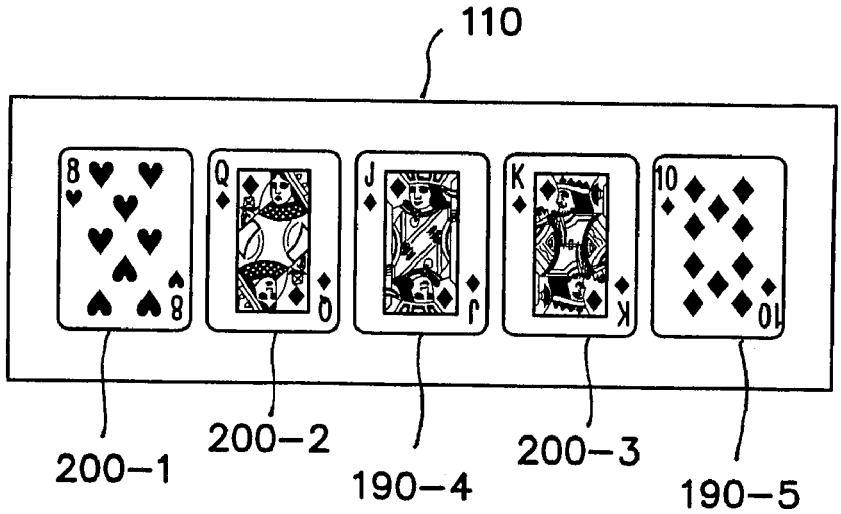
FIG. 3 shows the initial hand of FIG. 2A once the player has opted to place the second wager.

FIG. 3 shows the display 110, of FIG. 2A, once the player has opted to place the second wager and the gaming machine 100 has replaced three of the non-royal flush cards 190-1, 190-2 and 190-4 with three royal flush cards 200-1, 220-2 and 200-3 to the royal flush. By automatically replacing the non-royal flush cards 190-1, 190-2 and 190-4 with the ten of diamonds 200-1, queen of diamonds 200-2 and king of diamonds 200-3 the probability of receiving the royal flush is enhanced greatly. In fact, the player needs only the ace of diamonds to complete the royal flush.

A table 300 of possible payouts are set forth in FIG. 4. The pay table 300 shows the probabilities, possible payouts and corresponding house edge arranged according to the number of cards to the royal flush displayed initially. The payouts are exemplary and will be determined ultimately by the casino offering the embodiments of the present invention. Similarly, permitted amounts of the second wager will be determined ultimately by the casino.

In one embodiment, the royal flush is the only hand eligible for a payout once the second wager has been placed. Alternatively, however, there may also be payouts associated with receiving certain cards which do not complete the royal flush. For example, a player may be eligible for a payout if the player receives another diamond to form a flush, an ace (not a diamond suit) to form a straight or another jack, queen or king to form a high pair. The payouts (not shown) will be modest to reflect the high probability of such an occurrence.

Figure 5:
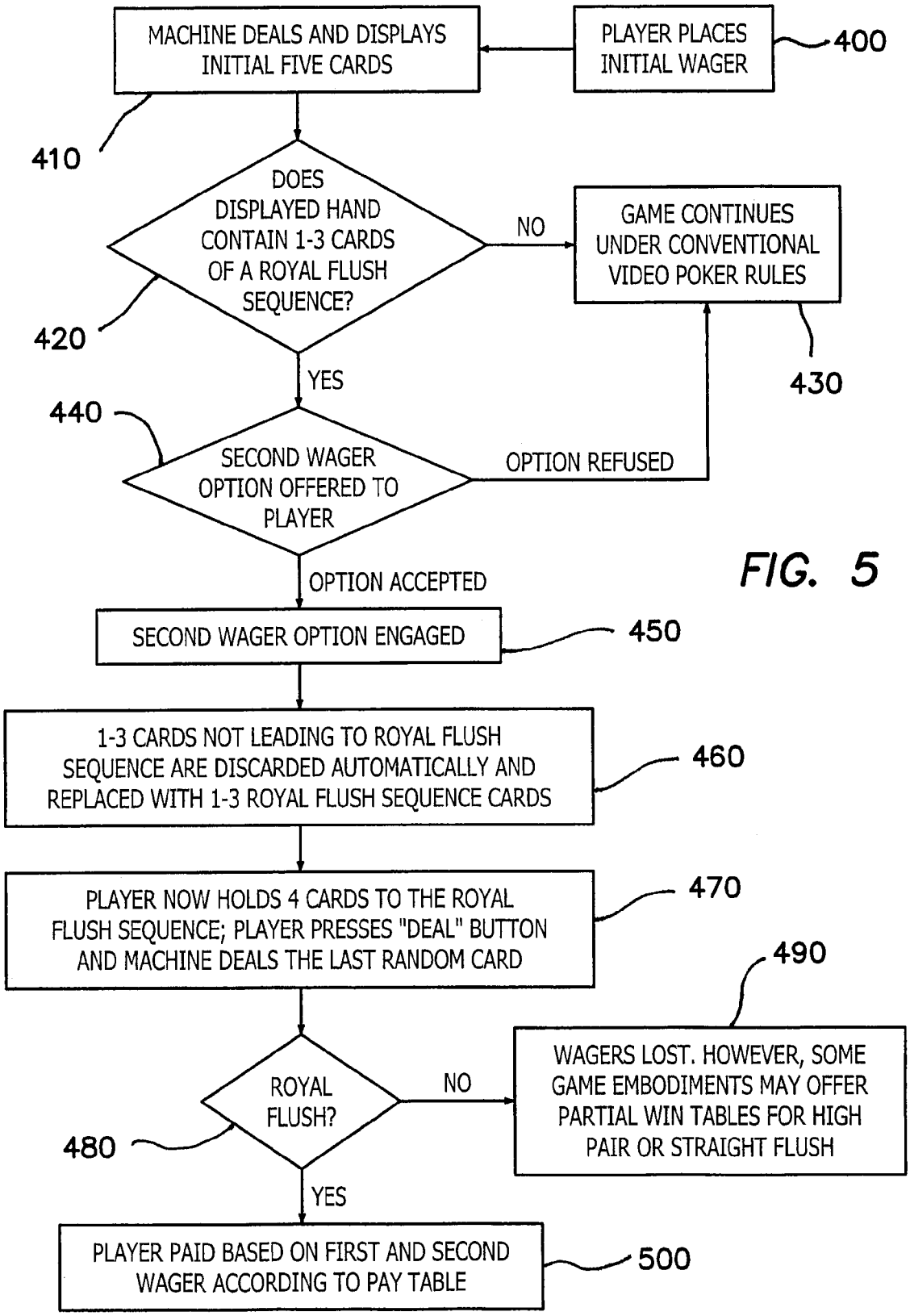
FIG. 5 shows a flow chart of a sample play of one embodiment of the present invention.

To clearly describe one embodiment of the present invention, FIG. 5 shows a flow chart outlining a sample play. At step 400 the player places an initial wager. At step 410, the gaming machine displays the initial five cards. At step 420, the player determines whether he has been dealt any cards to a royal flush sequence. At step 430 if no cards to the royal flush sequence have been dealt, the game continues according to the rules of conventional video poker. At step 440, if one, two or three of the cards to a royal flush have been dealt, the machine displays a player inquiry "Place Second Wager?" If the "Second Wager" option is refused, the game continues, at step 430, according to the rules of conventional video poker. If the player opts to place the "Second Wager", the wager amount is entered at step 450. The wager may be debited from a player's credit or may be in the form of additional cash inserted into the machine. Then, at step 460, one to three of the non-royal flush sequence cards are replaced with royal flush sequence cards so that the player is now one card away from the royal flush. In other words, the player is holding four cards to the royal flush sequence. At step 470 the player hits the deal button and the machine deals the randomly selected last card of the five card sequence. At step 480, the machine determines if a royal flush is displayed. At step 490 if there is no winning poker hand, the player loses his wagers. At step 500 if there is a royal flush displayed, the player is paid an award calculated by multiplying the amount of the second wager by the pay table odds. Under the alternative embodiment described above, other final poker hands may correspond to a modest payout.

Many variations of the above-described wagering game are possible without departing from the spirit and scope of the present invention. For example, players may only be provided with a number of replacement cards to form a hand with two or three cards to a royal flush. Such embodiments increase the payouts significantly while still facilitating more frequent royal flushes.

Thus, although the invention has been described in detail with reference to various embodiments, additional variations and modifications exist within the scope and spirit of the invention as described and defined in the following claims.

I claim:

1. A method of playing a poker video based wagering game comprising:

accepting an initial player wager;

said player receiving five or more random cards from one or more decks of cards;

said player selecting to hold one or more of the five or more random cards;

if said one or more hold cards is common to a royal flush, providing the player an opportunity to place a second wager;

if said player elects to place the second wager, replacing one or more of the non-hold cards with non-random specific cards needed for partial completion of the royal flush such that the player has a higher probability, but less than 100 percent, of successfully drawing the royal flush after placing the second wager than before placing the second wager;

randomly replacing, from each of the remaining cards in the one or more decks of cards, each of the player's cards not common to the royal flush, said remaining cards including cards having different suits than the hold cards; and awarding said player a payout if a player's final poker hand is the royal flush.

2. The method of claim 1 wherein if the player places the wager, the non-hold cards are replaced in such a number that the player holds a poker hand having four of the five cards necessary to complete the royal flush.

3. The method of claim 1 wherein if the player places the wager and the player's final hand is not a royal flush, the player continues to be eligible for an award based on the poker ranking of the player's final hand.

4. The method of claim 3 wherein the player receives an award if the poker ranking of the player's final hand is a pair of jacks or better.

5. The method of claim 1 wherein preestablished odds are related to the number of player selected hold cards common to the royal flush.

6. The method of claim 1 wherein the player initially receives five random cards.

7. The method of claim 6 wherein preestablished odds range from 40 to 1 to 50 to 1 on the wager.

8. The method of claim 1 wherein the player initially receives seven cards.

9. The method of claim 1 wherein the method is facilitated by an electronic gaming machine.

10. A method of playing a poker video based wagering game comprising:

accepting an initial player wager;

said player receiving five random cards from one or more decks of cards;

said player selecting to hold one or more of the five random cards;

if said one or more hold cards is common to a royal flush, providing the player an opportunity to place a second wager;

if said player elects to place the second wager, replacing one, two or three non-hold cards with non-random specific cards to form a poker hand having four of the five cards necessary to complete the royal flush thereby increasing a probability of the player obtaining a royal flush, wherein the probability is less than 100 percent;

randomly replacing, from remaining cards in the one or more decks of cards, the player's one card not common to the royal flush, said remaining cards including cards having different suits than the hold cards; and awarding said player a payout if the player completes the royal flush.

11. The method of claim 10 wherein the player is awarded a payout if the player's final hand is of a minimum preestablished poker ranking less than the royal flush.

12. The method of claim 11 wherein the minimum preestablished poker ranking is a pair of jacks or better.

13. The method of claim 10 wherein preestablished odds are in the range of 40 to 1 to 50 to 1 on the wager.

14. The method of claim 10 wherein the method is facilitated by an electronic gaming machine.

15. A gaming machine comprising:

a processor in communication with a random number generator and display;

one or more player interfaces;

said random number for generating a display of five or more random cards from one or more decks of cards;

said one or more player interfaces for allowing a player to place an initial wager and hold one or more of the five or more displayed random cards such that if said hold one or more cards is common to a royal flush, said processor for providing the player an opportunity to place a second wager;

if said player elects to place the second wager, said processor further for replacing one or more of the non-hold cards with non-random specific cards needed for partial completion of the royal flush such that the player has a higher probability, but less than 100 percent, of successfully drawing the royal flush after placing the second wager than before placing the second wager;

said random number generator further for causing replacement of each of the player's cards not common to the royal flush wherein said cards are replaced with cards remaining in the one or more decks of cards, said remaining cards including cards having different suits than the hold cards; and said processor further for awarding said player a payout if a player's final poker hand is the royal flush.

16. The gaming machine of claim 15 wherein said processor further for awarding a payout if the player's final hand is of a minimum preestablished poker ranking less than the royal flush.

17. The gaming machine of claim 16 wherein the minimum preestablished poker ranking is a pair of jacks or better.

18. The gaming machine of claim 15 wherein preestablished odds are in the range of 40 to 1 to 50 to 1 on the wager.

* * * * *